US008398229B2

(12) United States Patent
Vosahlo et al.

(10) Patent No.: US 8,398,229 B2
(45) Date of Patent: Mar. 19, 2013

(54) CURING

(75) Inventors: Jindrich Vosahlo, Cambridgeshire (GB); Carole Noutary, Kent (GB)

(73) Assignee: Inca Digital Printers Limited (GB)

( * ) Notice: Subject to any disclaimer, the term of this patent is extended or adjusted under 35 U.S.C. 154(b) by 31 days.

(21) Appl. No.: 12/843,450

(22) Filed: Jul. 26, 2010

(65) Prior Publication Data

US 2010/0309269 A1 Dec. 9, 2010

Related U.S. Application Data

(62) Division of application No. 10/540,130, filed as application No. PCT/GB03/05619 on Jul. 1, 2003, now Pat. No. 7,794,074.

(30) Foreign Application Priority Data

Dec. 20, 2002 (GB) ..... 0229825.5
Jul. 1, 2003 (WO) ..... PCT/GB03/02834

(51) Int. Cl.
*B41J 2/01* (2006.01)

(52) U.S. Cl. ..... 347/102; 347/101; 101/424.1; 156/272.2; 427/558; 427/492; 433/29; 438/715

(58) Field of Classification Search ..... None
See application file for complete search history.

(56) References Cited

U.S. PATENT DOCUMENTS 4,485,123 A * 11/1984 Troue ..... 427/492
5,981,399 A * 11/1999 Kawamura et al. ..... 438/715
6,017,660 A 1/2000 Palazzotto et al.
6,092,890 A 7/2000 Wen et al.
6,331,056 B1 12/2001 Nohr et al.
6,443,569 B1 9/2002 Mheidle et al.
6,457,823 B1 10/2002 Cleary et al.
6,739,716 B2 5/2004 Richards
7,104,642 B2 9/2006 Takabayashi
7,498,065 B2 3/2009 Siegel
2001/0046652 A1 11/2001 Ostler et al.
2002/0099111 A1 7/2002 Nohr et al.
2002/0149660 A1 10/2002 Cleary et al.
2003/0035037 A1 2/2003 Mills et al.
2003/0227527 A1 12/2003 Richards (Continued)

FOREIGN PATENT DOCUMENTS

EP 2 350 321 11/2000
EP 1 108 723 6/2001

(Continued)

OTHER PUBLICATIONS

UV LED Cure All from www.uvps.com/products/led cure-all, asp, printed Mar. 17, 2003, pp. 1-2.
HNG Series Membrane Nitrogen Generators from www. hankisonintl.com/new/htm, printed Oct. 8, 2002, multiple pages.
Hankinson International News Release from www.hankisonintl. com/new.htm, printed Oct. 8, 2002.

(Continued)

*Primary Examiner* — Matthew Luu
*Assistant Examiner* — John P Zimmermann
(74) *Attorney, Agent, or Firm* — Harness, Dickey & Pierce, P.L.C.

(57) ABSTRACT

A method of curing radiation-curable fluid is described. In one example, the method includes emitting radiation from an array of light-emitting diodes towards ink to be cured. LEDs are cheap, light weight, highly efficient in their conversion of electrical power, and give effectively instant switching to full power. Another advantage is that the emission spectrum of an LED is sharply peaked around the nominal frequency. Thus LEDs give several advantages over conventional radiation sources such as mercury lamps. A low oxygen environment is preferably provided at the radiation source to accelerate the curing reaction. Also described are inks which are specially formulated to respond to the radiation emission spectrum of an LED.

17 Claims, 7 Drawing Sheets

U.S. PATENT DOCUMENTS

| | | | |
|---|---|---|---|
| 2004/0011457 | A1 | 1/2004 | Kobayashi et al. |
| 2004/0090794 | A1 | 5/2004 | Ollett et al. |
| 2004/0189770 | A1 | 9/2004 | Hintermann |
| 2004/0189771 | A1 | 9/2004 | Hasebe et al. |
| 2006/0007290 | A1 | 1/2006 | Oshima et al. |

FOREIGN PATENT DOCUMENTS

| | | |
|---|---|---|
| EP | 1 428 670 | 6/2004 |
| GB | 2 350 321 | 11/2000 |
| GB | 2 399 162 | 9/2004 |
| JP | 2003-285423 | 10/2003 |
| WO | 99/19074 | 4/1999 |
| WO | 99/29787 | 6/1999 |
| WO | WO 02/053384 A1 | 7/2002 |
| WO | 03/044106 | 5/2003 |
| WO | 03/057488 | 7/2003 |
| WO | 2004/078477 | 9/2004 |

OTHER PUBLICATIONS

"An Introduction to UV Curing and the UV inerted curing process" by R.C. Denney, Fusion UV Systems Ltd from www.coatings.de/ren/reading/denney.htm printed Sep. 13, 2002.

UV Ink from www.dotrix.be/products technologies/technologies uv inks. asp, printed Sep. 13, 2002.

UV Lamp using 370nm UV LED for UV Rays Applications from www.marubenisunnyvale.com/uv lamp.html, printed Sep. 13, 2002.

Primare UV Lamps from www.primarcuv.com/primarcuv/electroderfg.htm, printed Sep. 13, 2002.

2000 and beyond: LEDs Reach Across Temporal and Spectral Boundaries from http://ledmuseum.home.att.net/2000.htm, printed Sep. 13, 2002.

UV Curing Technical Information Page from www.uvcuring.com/uvguide/chap3 1/chapter 31.htm, printed Sep. 13, 2002.

* cited by examiner

CURING

CROSS-REFERENCE TO RELATED APPLICATIONS

This is a divisional application of U.S. Ser. No. 10/540,130 filed Oct. 26, 2006 which is a national phase application of PCT/GB2003/005619 filed Dec. 22, 2003, claiming priority to Great Britain Application Nos. 0229825.5 filed Dec. 20, 2002 and PCT/GB03/002834 filed Jul. 1, 2003, all of which are incorporated by reference in their entirety herein.

BACKGROUND OF THE INVENTION

The invention relates to curing. The invention finds particular application in the curing of ink, in particular the curing of radiation-curable inks. Preferred examples of the invention relate to UV curing. Particularly preferred examples of the invention relate to the curing of ink jet inks, in particular UV curable ink jet ink. Other aspects of the invention relate to ink compositions.

While embodiments of the invention described herein relate to ink, which is used to print a graphic image, the invention has general applicability to other curable fluids, and need not relate to printed graphical images, or even to printed images. For example, the fluid could comprise a pcb etch resist, plastic electronic material or other material. Where reference is made to "ink" herein, it is to be understood that, preferably, that term is to include reference to other fluids, where appropriate.

Furthermore, while in examples described herein the fluid is applied to a substrate by printing, other methods could be used.

The use of curable inks in printing is well known. Curable ink is preferably to be understood to include ink that solidifies by reaction, in particular for example polymerisation and/or crosslinking. For many curable inks, the ink (for example liquid ink) is solidified by exposing the ink to radiation. Of particular interest is UV curing ink.

In the use of UV curable inks, the ink is deposited on a substrate using a suitable method. Exposing the ink on the substrate to UV light effects cure of the ink. In some examples, the exposure of the ink to UV light initiates a chemical reaction that turns the liquid ink into a solid. In other examples, curing can be effected using other curing radiation, for example gamma radiation. Radiation curable inks may be cured using an electron beam, for example from an electron gun. Some inks can be cured simply by applying heat, for example employing an IR source. However, the heat input required to achieve a temperature for rapid cure is often too high for this to be an attractive method. The ink may comprise aqueous UV ink.

One of the main problems in designing printers to print using curable ink is the provision of a suitable radiation source to effect the curing. For UV curing, the most widely used technology is a mercury discharge lamp; examples of such lamps are mercury lamps produced by Primarc UV Technology (NJ, USA). However, such lamps have a number of disadvantages.

Firstly, little of the electrical energy consumed by the lamp is converted into UV energy. Typically only 10 to 15% of the input power effects emission in the desired wavelengths of 250 to 390 nm. The remainder is either emitted at other (mainly longer) wavelengths, or as heat. This heat must be taken away from the lamp by conduction or convection. This waste heat can cause problems because it can effect heating of the substrate to which the ink is being applied, and also because the lamp requires active cooling which is expensive, especially if the UV lamp is mounted on a moving carriage on the printing apparatus.

Secondly, the UV output obtained from the lamp is highly sensitive to the operating temperature of the lamp. It is difficult to control the operating temperature accurately, and hence to ensure that the emitted UV is constant. A more important problem is the speed of response of the lamp. Starting from cold, it can take half a minute or more to warm the lamp up to full operating temperature, during which time the UV output is rising to its rated value. This can be a particular problem for printers where the UV is needed intermittently during the scanning of the printhead assembly over the substrate. Keeping the UV lamp at full power all the time would be wasteful, and would also cause further problems associated with stray UV radiation from the lamp which could have safety implications and might lead to unwanted curing of the ink in the printheads themselves.

Typically the bulb of the UV lamp is held in "standby mode" when it is not in use, at a reduced power level of perhaps 20% of rated input power. This keeps the bulb warm, but there is still a substantial amount of waste heat generated, which must be removed. In practice, because the lamp cannot be switched on and off quickly from cold, a mechanical shutter is often used to reduce the amount of stray UV emitted when the lamp is in standby mode.

The spectrum of UV emission from mercury arc lamps is in a number of very sharp peaks (emission lines), which are spread over a range of wavelengths. When considering the target material, for example a UV curing ink, it can be seen that it is very difficult to match the sensitivity of the ink to a set of very narrow emission lines which are spread over a range of frequencies. In practice, a combination of several initiators are used in the inks, which are designed to absorb over a broad range of frequencies so that they can make use of most of the UV output of the lamp. This tends to make the inks more sensitive to stray light (for example sunlight) which is often broad band. This can increase the likelihood that the ink is cured by stray light before it is deposited on the substrate.

Also, in many cases, the intensity of UV output along the length of a mercury discharge lamp is uneven. This appears to be an unavoidable property of the lamps in practice, and can result in variations in the appearance of the final ink film.

Furthermore, the lamps (together with their reflectors, cooling and shuttering) are bulky and heavy. This is particularly a disadvantage when the lamps are mounted on a moving carriage.

SUMMARY OF THE INVENTION

It is an object of the invention to solve or mitigate one or more of those problems.

In a first aspect of the invention, there is provided a method of curing a radiation-curable fluid, the method including emitting radiation from a radiation source towards the fluid to be cured, wherein at least 90% of the radiation has a wavelength in a band having a width less than 50 nm; and providing an inerting environment in the region of the radiation source.

By providing the inerting environment, for example a reduced oxygen environment, inhibition of cure of the fluid due to the oxygen in the environment can be reduced and thus the cure reaction can be accelerated by reducing the fluid's exposure to oxygen.

Preferably the term "inerting" is to be understood to refer to an arrangement in which the inerting gas or environment has the effect of reducing inhibition of cure of the ink.

The inerting gas or environment may be itself inert, but in many cases it will be sufficiently inerting without itself being completely inert. Thus a low-oxygen gas may provide an inerting environment.

It will be understood that other environments could be used to create an "inert" or low oxygen environment. For example an argon environment could be used. It will be understood that the composition of the inerting environment will be chosen having regard to the cost, safety and complexity of installing the system, against the requirements for the particular ink and LED arrangement. For example, for a nitrogen environment, an amount of oxygen in the nitrogen supply could be tolerated in some situations.

Carbon dioxide gas could be used, which is cheaper than argon and, in some situations, can be safer than other gases because it provokes a "choking" response in humans.

It will be understood, that the environment provided is preferably sufficiently "inert" that the desired cure can be obtained using the LEDs of the arrangement. In some cases, this will be a full cure of the ink; in others it may comprise a partial cure of the ink, for example to "fix" it on the surface of the substrate to which it is applied.

Such a method using an "inerting" environment is of particular application for arrangements where an ink which cures using a free radical mechanism is used.

A broad aspect of the invention provides a method of curing a radiation-curable fluid, the method including emitting radiation towards the fluid and providing means for accelerating the curing of the fluid.

Preferably, the method includes providing a reduced oxygen environment in the region of the radiation source. This feature is particularly preferred where the mechanism by which the fluid cures includes free radical formation.

In practice, for some sources and fluids, it may not be possible to achieve full curing of the fluid by simply providing the source in atmospheric conditions, for example where substituting LEDs for mercury arc sources.

In particular, where UV curing is initiated by free radicals, the curing is sensitive to oxygen inhibition. The presence of oxygen can lead to quenching of the active excited state of the photoinitiator as well as to the scavenging of the free radicals generated by the initiator. An increased rate of oxygen inhibition not only reduces the rate of cure, but can also affect the coating properties of the "cured" fluid, for example ink. When using fluid which cures by a mechanism including free radical curing technology, therefore, it is preferred to reduce (or eliminate) the amount of oxygen present in the fluid coating and adjacent exterior surfaces of the fluid coating.

The curing of fluid which cure using free radical curing technology, for example free radical curing UV inks, may be retarded due to the presence of oxygen in the area adjacent the fluid to be cured. Where conventional sources of radiation are used, the amount of energy produced by the source can often overcome the retarding effect of the oxygen. However, the radiation emitted by the source may not, in some cases, have sufficient energy to react with the reactive groups in the fluid (for example photoinitiator molecules) to generate enough free radicals to effect full cure at atmospheric conditions.

By providing a reduced oxygen environment, the desired cure can be effected, in particular for free radical curing fluids. Preferably a blanket of reduced oxygen gas is provided over an area of the fluid to be cured.

Preferably the percentage by volume of oxygen in the region of the ink adjacent the source is less than 5%, preferably less than 2%, more preferably less than 1%. The acceptable level of oxygen in the gas at the fluid surface will depend on the intensity of the radiation, the chemistry of the fluid used (for example the amount and type of photoinitiator included in the ink), the thickness of the film to be cured, the amount of cure required, the degree of entrainment of the atmosphere into the region adjacent the fluid to be cured and other factors.

Preferably, the method further includes the step of applying the fluid to a substrate, the radiation being emitted towards fluid on the substrate, wherein a reduced oxygen environment is not provided in a region where the fluid is being applied to the substrate.

In many arrangements, it will be important that the cure of the fluid is not accelerated before it is deposited onto the substrate. For example, where the fluid is printed onto the substrate, preferably the low oxygen environment is not associated with the printhead nozzles or the region through which the droplets of fluid pass from the nozzles to the substrate.

Preferably the low oxygen/inerting environment is local to the radiation source. In this way, preferably the atmosphere can be controlled under the source, while the print remains in normal atmospheric conditions.

Preferably the method further includes providing a shroud in the region of the radiation source.

The shroud can preferably contain the inerting environment adjacent the radiation source.

Preferably the method further includes the step of providing a nitrogen inerting environment. There are several options for achieving this. Using a local nitrogen atmosphere, can reduce the inhibition of the free radical reaction by the presence of oxygen, which diffuses into the fluid surface. Mercury arc lamps overcome the effect of oxygen inhibition by emitting enough power such that the rate of free radical production exceeds the rate at which oxygen diffusion can inhibit the reaction.

Whereas the need to use a nitrogen atmosphere adds complexity to the system, this can be more than compensated by other advantages in using lower power sources, for example LEDs.

Preferably the method includes the step of feeding a low oxygen gas to a region adjacent the source. Preferably, nitrogen is fed locally to the source.

Preferably the method further includes providing a gas curtain in front of the source.

The provision of the gas curtain can disrupt the boundary layer and hence reduce the amount of oxygen entrained under the source. The substrate will tend to entrain fresh air with it as it travels under the blanket of gas providing the "inert" atmosphere. This entrained air will have a higher percentage of oxygen and therefore reduce the effectiveness of the blanket of gas for reducing oxygen inhibition.

By providing a gas curtain, for example a jet of gas directed to the surface of the substrate upstream of the source, the amount of air entrained by the movement of the substrate can be reduced. In some cases, a jet of "inert" gas, for example nitrogen gas (including little or no oxygen) could be jetted towards the surface of the substrate.

Preferably the source of nitrogen comprises a membrane nitrogen source. For example, a HNG Series Membrane Nitrogen Generator of Hankison International.

Such a source can provide nitrogen gas having between about 95% and 99.5% purity.

Preferably the method includes providing a directable outlet for the low oxygen gas.

By directing the outlet, the flow of gas adjacent the source can be altered.

Preferably the method includes the step of supplying gas at a positive pressure in the region of the radiation source (for example an LED). By applying a positive pressure, ingress of, for example, air into the region adjacent to the source can be reduced. This is of particular benefit where an inerting environment is supplied adjacent the source.

Preferably an inerting gas is supplied adjacent the source and effects the positive pressurisation. The supply of gas can also have the advantage in cooling the source.

Where the source is mounted in a cavity, preferably the method includes the step of positively pressurising the cavity. In an example, the inerting gas may be supplied through holes arranged among the LEDs of an LED array.

Another advantage of the positive pressurisation is that this could help keep the region blanketed with the inerting gas if only part of the array were over a thick substrate, for example at the start or end of a print scan. This could give better curing of ink deposited at the edges of a substrate.

Preferably the method includes the step of cooling the source of radiation.

Preferably, the radiation source includes an LED.

A broad aspect of the invention provides a method of curing radiation-curable ink, the method including emitting radiation from a light emitting diode towards ink to be cured.

Light emitting diodes (LEDs) are well known. Such sources of radiation are cheap, light weight, highly efficient in their conversion of electrical power, and can give effectively instant switching to full power. Another advantage is that the emission spectrum of an LED is usually a sharp peak. Typically over 90% of the emission is within about 15 nm of the peak.

LED devices therefore overcome many of the disadvantages of existing curing devices listed above.

The LED may be used to effect a full cure of the fluid, or may be used with another method, for example another radiation source, to cure the fluid, and/or may effect partial cure of the fluid.

The source may be chosen to emit radiation of any wavelength desirable to effect cure of the fluid. It will be understood that the radiation emitted will not necessarily be in the visible spectrum.

Preferably the source emits UV radiation. Thus the source can be used to effect cure of UV-curable ink. Preferably the source, for example LED, emits radiation having a wavelength between 200 and 400 nm, preferably less than 400 nm.

The following description relates to LED sources and ink, but it will be understood that, preferably, it also applies to other sources, for example laser sources and other fluids.

It will be understood that the LED source will usually emit radiation having a spread of wavelengths. The width of this band of wavelengths will be significantly less for a LED source than, for example, a mercury source and for preferred LED sources, at least 90%, preferably at least 95%, of the emitted radiation has a wavelength within a band of about 50 nm or less.

Where reference is made herein to the radiation having a particular wavelength, preferably the peak of the spectrum of radiation emitted by the source is at that particular wavelength.

Preferably the wavelength of the LED is chosen substantially to match the absorption profile of the ink, for example a photoinitiator in the ink, or vice-versa. Preferably, the wavelength of the emitted radiation is in the range of 280 to 450 nm, which is normally present only at low intensities in ambient lighting. In this way, stray radiation is less likely to cure the ink before the desired curing time, for example the ink in the printheads themselves is less likely to cure when exposed to ambient lighting. The LED to be used could be chosen on the basis of the properties of the ink to be used, or the ink could be formulated to respond to the emission of the LED, or a combination of the two.

LED sources are available which emit at the blue end of visible spectrum (around 405 nm) and in the near UV (at 370 nm and also 385 nm). The trend is to LEDs emitting at shorter wavelengths becoming available. Thus UV-LEDs can be used in arrangements where previously a mercury vapour lamp, having the disadvantages described above, might have been used.

With curing using an LED, the light can be emitted over a much narrower wavelength region compared with conventional sources of radiation, and typically above 300 nm.

This can eliminate most of the issues linked to competition between photoinitiators and other ink components for the available light. Practically, this means that in some cases only one photoinitiator may be required in an ink designed to be cured using an LED source. Optimum efficiency of the photoinitiator, and therefore of the ink, can be obtained when LEDs emit above 300 nm, in some cases.

Preferably the ink is a UV-curable ink.

Preferably, the method includes emitting radiation from an array of LEDs towards the ink. Where an array of LEDs is used for curing the ink, preferably the LEDs all emit radiation of substantially the same wavelength, although it is envisaged that a selection of wavelengths might be used to effect cure.

When using currently available LEDs, it is found that more than one LED is required to give the required intensity of radiation to effect cure. Currently available LEDs have relatively low output compared with radiation sources conventionally used to cure ink and in some arrangements many LEDs are needed, for example in order to achieve the total UV power of a typical mercury source.

By using an array of radiation sources, for example LEDs, the intensity of radiation emitted towards an area of ink can be made more even compared with a case where a few, or one, LED is used. A single LED would give an intense spot of radiation in an area; by using an array of LEDs, the intensity of radiation received by areas of ink can be made more even, thus giving better results from the curing.

Preferably, the radiation is emitted from an elongate source. The source preferably includes an array of LEDs. Preferably the width of the source is selected on the basis of the relevant dimensions of the nozzle row. Preferably the width of the array is such that as a "stripe" of ink is emitted in a pass of a printhead, the source emits radiation towards substantially the whole width of the stripe. In preferred examples, the width of the source at least approximately corresponds to the width of the nozzle array of the printheads used.

The length of the array in the direction parallel to the cure direction will be chosen with regard to, for example, the speed of relative movement of the substrate and the source and the intensity of radiation required to effect cure.

Preferably, the source comprises an array of LEDs and is moved relative to the ink to be cured in the cure direction, wherein the LEDs do not form a column substantially aligned with the cure direction. If the LEDs were so aligned, then there might be regular patterns in intensity of the radiation formed across the width of an area of ink perpendicular to the cure direction. This might, in turn, lead to visible variations in the cured ink across the area. By staggering the LEDs of the array, such a situation might be avoided, or the risk of visible variations being formed might be reduced.

The cure direction (preferably the direction of relative movement between the radiation source and the printed ink during cure) and the print direction (preferably the direction of relative movement between the substrate and the printing nozzles during printing) may be in the same direction, for example where the radiation source is mounted on the print carriage, but the directions may be different in other arrangements.

A preferred array of LEDs includes a plurality of rows substantially aligned in a direction substantially perpendicular to the cure direction, the rows being offset so that the LEDs are not aligned parallel to the cure direction.

Preferably the LEDs of the array are offset in a direction substantially perpendicular to the cure direction so that no columns of LEDs are present which would produce artifacts, for example at the pitch of the LEDs.

One way to do this is to offset each adjacent row of LEDs by a distance w/N where w is the pitch of the LEDs parallel to the cure direction and N is the number of rows in the cure direction.

Alternatively, the rows could be offset by 2w/N, 4w/N or 6w/N, and so on, but such arrangements are generally less preferred since more LEDs are used at the side edges of the array. In preferred arrangements, the array is in the general form of a parallelogram, but may comprise staggered rows out of sequence.

Thus, preferably, the source comprises N rows of LEDs, the LEDs of each row having a pitch of w along the row direction, and wherein each row of LEDs is offset by Yw/N from an adjacent row, wherein Y, w and N are integers (and preferably where Y is not equal to N).

Preferably the edge of the array is such that the intensity of radiation across a print swathe is substantially constant. Preferably the edge of the array is angled with respect to the cure direction. Preferred arrays are generally in the shape of a parallelogram or trapezium, although other shapes might be used.

One of the important benefits of using an fluid in the curing of ink, is that the radiation emitted by the LED falls within a narrow band of wavelengths compared with other sources. Some LED sources, for example produce radiation having wavelength such that at least 90% is within a band of approximately 30 nm.

Preferably, the ink (or other fluid) includes a photoinitiator adapted to respond to radiation emitted by the source, a photosensitiser adapted to respond to radiation emitted by the source and/or a photosensitiser adapted to alter, preferably to extend, the spectral response of the radiation-curable fluid.

Preferably the fluid comprises ink, preferably ink jet ink. Preferably the ink comprises UV-curable ink jet ink. Ink jet ink preferably includes any ink which is able to be applied to a substrate using an ink jet printhead.

Preferably the method further includes applying the ink to a substrate using an ink jet printing technique.

A broad aspect of the invention provides a method of curing radiation-curable fluid, the method including emitting radiation from a source towards fluid to be cured, wherein at least 90%, preferably at least 95% of the radiation emitted from the source has a wavelength in a band having a width of less than 50 nm. Preferably the band has a width of less than 40 nm, preferably less than 30 nm. The source of radiation may comprise, for example, a light emitting diode, or laser diode.

Preferably the fluid is adapted such that it is substantially reactive (and/or such that cure is effected) when exposed to radiation of a predetermined wavelength, preferably the wavelength of the radiation emitted. Preferably it is sufficiently reactive that the fluid is cured when exposed to the radiation of the predetermined wavelength.

Preferably the fluid is strongly reactive when exposed to the radiation of the predetermined wavelength. A large potential improvement in the system performance can be obtained by selecting a fluid having an absorption matched, or closely matched to the output of the chosen source. Preferably, the fluid is adapted to be highly reactive when exposed to the narrow wavelength spectrum of the output of an LED.

Preferably the band of wavelengths which can effect cure (or partial cure) is narrow, to reduce the risk of stray radiation, for example from sunlight, effecting cure or partial cure before required. Preferably at least the band is less than 50 nm, preferably less than 30 nm, preferably less than 20 nm, preferably more than 10 nm.

Preferably the method further includes the step of varying the power of the radiation source.

Preferably the input power is varied to vary the intensity of the radiation applied to the fluid.

It has been found that variations in surface finish of, for example, ink on a printed substrate can occur if the amount of curing radiation received by the ink changes.

In some cases, a desired surface finish (for example gloss or matte) can be achieved by selecting the desired curing radiation.

Furthermore, the curing radiation emitted by a radiation source can be controlled so that undesirable variation in surface finish can be avoided.

For example, where the radiation source is mounted to moving printheads, variations in speed of movement of the printheads may lead to undesirable variation in the surface finish of the ink. By varying the power input of the source (and hence the radiation intensity), a similar (desired) level of gloss can be maintained. As the printheads move faster, the radiation intensity is increased.

Furthermore, in some cases for example, the radiation source is arranged to index as the printheads index along the image. If a small image is to be printed, the source indexes at short time periods compared with the case where a larger image is printed.

In such arrangements, the curing source intensity may need to be increased to maintain complete cure. Alternatively, the indexing of the source may be delayed, thus slowing down the total print time.

Preferably the method includes varying the level of cure depending on the rate of printing. Preferably the dose of curing radiation applied to a region of fluid is varied so as to vary the level of gloss of the cured fluid.

In some arrangements it is advantageous to carry out a first "partial cure" of the fluid to "fix" the fluid on the substrate, before carrying out a subsequent full cure. The partial cure may be carried out by the same or different source of radiation.

Preferably, in the partial cure step, no inert environment is provided, so that cure is not accelerated. The inert environment if preferably applied for the full cure step.

A further aspect of the invention provides an ink including at least one radiation-polymerisable monomer, oligomer or prepolymer and a photoinitiator system containing a photoinitiator wherein the photoinitiator system is adapted to absorb radiation having a wavelength between from 280 to 450 nm and to absorb sufficient radiation within a 50 nm band width to effect cure of the ink.

Radiation having a wavelength above 300 nm is generally very efficient at penetrating through the ink coating while radiation having a wavelength less than 300 nm is generally not since penetration through the ink media is often difficult due to absorption by acrylate monomers in this region.

Indeed, the components of the ink, particularly UV monomers, tend to absorb the radiation having a wavelength under 300 nm and therefore compete strongly with the photoinitiators for the available UV light, often making curing through thick pigmented coatings very difficult. This explains why a combination of photoinitiators is typically used in UV curable inks: those absorbing below 300 nm are used for effective surface cure while those absorbing above 300 nm are efficient to penetrate through the ink coating, because of low competition for the light from other ink components.

The cure effected may comprise full cure of the ink, or may, in some examples, comprise partial cure.

Preferably, the ink is substantially free of water and/or volatile organic solvents.

Preferably the ink further includes at least one colouring agent.

Preferably the ink contains one or more of a radiation-polymerisable monomer, oligomer or prepolymer which are unsaturated organic compounds which polymerise by irradiation in the presence of a photoinitiator system. Such radiation-polymerisable monomers, oligomers or prepolymers are well known in the art.

Preferably they include (meth)acryaltes, wherein the term (meth)acrylate preferably means acrylate and/or methacrylate. Examples of suitable monomers include hexanediol diacrylate, trimethylolpropane triacrylate, pentaerythritol triacrylate, polyethyleneglycol diacrylate (for example, tetraethyleneglycol diacrylate), dipropyleneglycol diacrylate, tri(propylene glycol)triacrylate, neopentylglycol diacrylate, bis(pentaerythritol) hexaacrylate, and the acrylate esters of ethoxylated or propoxylated glycols and polyols, for example, propoxylated neopentyl glycol diacrylate, ethoxylated trimethylolpropane triacrylate, and mixtures thereof.

Particularly preferred are difunctional acrylates with a molecular weight greater than 200. Esters of methacrylic acid (i.e. methacrylates) can include, for example, hexanediol dimethacrylate, trimethylolpropane trimacrylate, triethyleneglycol dimethacrylate, diethyleneglycol dimethacylate, ethyleneglycol dimethacrylate, 1,4-butanediol dimethacrylate. Mixtures of (meth)acrylates may be used.

Examples of oligomers are esters of acrylic acid and polyurethanes, epoxies, polyesters, polyethers and melamines.

Preferably the radiation-polymerisable monomer, oligomer or prepolymer is present in an amount from 50 to 95% by weight, preferably from 60 to 80% by weight based on the weight of the ink composition.

The role of a photoinitiator is to generate reactive species on exposure to the radiation; the reactive species initiate the polymerisation reaction which effects cure.

These reactive species can be free radicals (for free radical curing ink) or acids (for cationic curing ink) depending on the monomers that are used in the ink, and effect radical or cationic polymerisation.

Commercially available photoinitiators can be used in combination to absorb radiation over a broad spectrum of wavelengths and thus are suitable for use with a conventional medium pressure mercury lamp (which emits radiation in a relatively broad spectrum of wavelengths as described above). Since some radiation sources, for example LEDs, generate a much narrower emission band than conventional sources, for example mercury lamps, it is advantageous that the photoinitiator or mixture of photoinitiators selected for inclusion in the ink to be cured absorb strongly enough in the particular narrow wavelength band of the source.

For curing using LEDs, the photoinitiator or photoinitiators are preferably selected specifically to absorb the radiation in the LED emission spectrum.

Currently commercially available LEDs generally generate radiation at a higher wavelength than conventional UV lamps and generally photoinitiators do not specifically absorb the radiation strongly in this spectral band.

To optimise the reactivity of radiation curable ink for use with a radiation source such as an LED, it is possible to incorporate into the ink a sensitiser that allows the spectral sensitivity of the photoinitiators in the ink to be extended. This is particularly preferred where the emission radiation wavelength for the source is relatively high, for example 400 nm, compared with conventional sources, for example UV lamps.

Photosensitisers are molecules that are selected to absorb strongly in the desired spectral band, and are able to transfer the absorbed energy to the photoinitiators in the ink. Therefore, although the sensitiser might not generate initiating species directly itself, it enhances the reactivity of the system by transferring energy to the photoinitiator, which in turn is able to generate more initiating species.

The term "photoinitiator system" used herein preferably means either one or more photoinitiators or a mixture of one or more photoinitiators and one or more photosensitisers. Preferably the photoinitiator system is present from 1 to 10% by weight, preferably from 2 to 8% by weight, of the ink. In fact, one of the advantages of the present invention is that a reduced quantity of photoinitiators and photosensitisers, which are expensive components, is sufficient to cure the ink, for example because components may be chosen which respond to the specific wavelengths emitted by the LED source used.

The photoinitiator system contains at least one photoinitiator and, optionally, at least one photosensitiser. The photoinitiator system preferably absorbs radiation in a region from 280 to 450 nm and absorbs sufficient radiation to cure the ink within a 50 nm or smaller, preferably less than 30 nm, particularly preferably less than 20 nm, band width.

Preferably the photoinitiator system comprises a radical photoinitiator selected from 1-hydroxycyclohexyl phenyl ketone, 2-benzyl-2-dimethylamino-(4-morpholinophenyl) butan-1-one, benzildimethylketal, bis(2,6-dimethylbenzoyl-2,4,4-trimethylphenylphosphine oxide, 2,2-Dimethoxy-1,2-diphenylethan-1-one, 2-Methyl-1(4-(methylthio)phenyl)-2-morpholinopropan-1-one, Bis(.eta. 5-2,4-cyclopentadien-1-yl)-bis(2,6-difluoro-3-(IH-pyrrol-1-yl)-phenyl)titanium or mixtures thereof; or a cationic photoinitiator selected from a diaryliodonium salt, a triarylsulphonium salt or mixtures thereof; or one or more photoinitiators together with a photosensitiser selected from ketocoumarins, thioxanthone or mixtures thereof.

In some cases, the suitability of an ink for curing with the radiation source can be assessed by measuring the optical density (or absorbance) of the ink at the relevant emission wavelength of the radiation source. Preferably the absorbance is measured at the peak emission wavelength of the source, preferably at the maximum emission wavelength for the source.

The absorbance is a measure of the intensity of the incident radiation emitted towards a sample compared with the intensity of radiation transmitted through the sample.

The absorbance of the ink at a specific wavelength can, for example, be measured by obtaining a UV absorption spectrum of the ink diluted to a 1 to 5000 ratio in an organic solvent (for example acetonitrile). The UV absorption spectrum can be measured with a UV spectrophotometer over the selected wavelength region; in the present example Lambda 40 equipment from Perkin Elmer was used.

Preferably the absorbance of the ink at a 1 to 5000 dilution as described at the radiation source peak emission wavelength (preferably maximum emission wavelength) is at least 0.05, more preferably at least 0.1, more preferably at least 0.2.

A broad aspect of the invention provides an ink having such an absorbance, preferably an ink adapted to be cured using an LED. A greater absorbance can give better cure using the radiation source.

Preferably, such an ink includes not more than 10% by weight, preferably not more than 8% by weight of photoinitiator system.

The ink jet ink of preferred examples also includes a colouring agent, which may be either dissolved or dispersed in the liquid medium of the ink. Preferably the colouring agent is a dispersible pigment, of the types known in the art and commercially available such as, for example, under the trade-names Paliotol (available from BASF plc), Cinquasia, Irgalite (both available from Ciba Speciality Chemicals) and Hostaperm (available from Clariant UK). The pigment may be of any desired colour such as, for example, Pigment Yellow 13, Pigment Yellow 83, Pigment Red 9, Pigment Red 184, Pigment Blue 15: 3, Pigment Green 7, Pigment Violet 19, Pigment Black 7. Especially useful are black and the colours required for trichomatic process printing. Mixtures of pigments may be used. The total proportion of pigment present is preferably from 0.5 to 15% by weight, more preferably from 1 to 5% by weight.

For ink jet applications, the inks should be able to flow rapidly from the printing heads, and, to ensure that this happens, they require in use a low viscosity, typically below 100 mPas at 25 C although in most applications the viscosity should be below 50, preferably below 25 mPas.

Other components of types known in the art may be present in the ink to improve the properties or performance. These components may be, for example, surfactants, defoamers, dispersants, stabilisers against deterioration by heat or light, reodorants, flow or slip aids, biocides and identifying tracers.

Preferably the ink is substantially free of water and volatile organic solvents, and preferably it includes at least one radiation-polymerisable monomer, oligomer or prepolymer, at least one colouring agent, and a photoinitiator system containing at least one photoinitiator. Optionally, at least one photosensitiser may be used wherein the photoinitiator/photosensitiser system absorbs radiation in a region from 280 to 450 nm and absorbs sufficient radiation within a 50 nm band width to cure the ink.

A further aspect of the invention provides the use of radiation source having a narrow spectral output in the curing of radiation-curable inks. Preferably the source comprises an LED.

A further aspect of the invention provides a radiation-curable ink, wherein the ink is adapted such that cure is effected when the ink is exposed to radiation of a predetermined wavelength. Preferably the ink has one or more of the features as described above.

A further aspect of the invention provides apparatus for curing radiation-curable ink, the apparatus including a light emitting diode arranged to emit radiation towards ink to be cured.

A further aspect of the invention provides apparatus for curing a radiation-curable fluid, the apparatus including a radiation source for emitting radiation towards the fluid to be cured, wherein at least 90% of the radiation has a wavelength in a band having a width of less than 50 nm; and means for providing an inerting environment in the region of the radiation source.

Preferably, the radiation source comprises an LED.

Preferably the source is adapted to emit UV radiation. Preferably the apparatus includes an array of sources.

Preferably the apparatus includes an elongate source of radiation. Preferably the source comprises an array of LEDs and is arranged to move relative to the ink to be cured in a cure direction, wherein the LEDs do not form a column substantially aligned with the cure direction.

Preferably the apparatus includes a reduced oxygen gas source, preferably a nitrogen source.

Preferably the apparatus further includes a printhead, wherein the arrangement is such that the inerting environment is not provided in the region of the printhead.

Preferably the apparatus further includes a shroud in the region of the radiation source.

Preferably the apparatus includes means for providing a gas curtain in front of the source. This preferably includes a nozzle arranged to direct gas, for example air, or low oxygen gas, for example nitrogen to the substrate upstream of the curing arrangement.

Preferably the apparatus includes an outlet for the gas, wherein the outlet is directable.

Preferably, the apparatus includes a gas outlet adjacent the source for supplying gas at a positive pressure in the region of the source. Where the radiation source includes an array of LEDs, the apparatus may include a plurality of outlets, for example. holes, amongst the LEDs.

The apparatus may include a cavity, the source being mounted in the cavity, the apparatus including means for positively pressurising the cavity.

Preferably the apparatus includes means for cooling the source of radiation, for example a fan, a heatsink and/or a cooling fin.

Preferably the fluid is ink.

The invention further provides apparatus for curing radiation-curable fluid, the apparatus including a radiation source for emitting radiation towards fluid to be cured, wherein at least 95% of the radiation emitted from the source has a wavelength in a band having a width of less than 50 nm.

Preferably the fluid is adapted such that it is reactive when exposed to radiation of a predetermined wavelength.

Although the invention is applicable to curing any UV curable fluid, it is particularly advantageous for UV curable inkjet inks, since the LED curing equipment can be lightweight in comparison with the Mercury Halide lamps, normally used. This is particularly an advantage if the curing equipment is to be attached to the moveable carriage of the inkjet printing head. Ink jet ink preferably includes any ink which is able to be applied to a substrate using an ink jet printhead.

Preferably the apparatus further includes an ink jet printhead for emitting ink onto a substrate.

Also provided by the invention is a printer including apparatus as described herein. The radiation source may be moveably mounted in the printer, for example in arrangements where the ink is deposited in several passes. In other arrangements, the radiation source may be fixed; such an arrangement might be used for applications involving single pass printing.

Preferably the printer comprises an ink jet printer.

A further aspect of the invention provides an array of light emitting diodes adapted for use in curing ink in an ink jet printer.

The invention also provides a method and/or apparatus and/or ink being substantially as herein described with reference to one or more of the accompanying drawings.

Any feature in one aspect of the invention may be applied to other aspects of the invention, in any appropriate combination. In particular, method aspects may be applied to apparatus aspects, and vice versa.

A preferred apparatus provides a source of curing radiation comprising a light emitting diode, a suitable source of electrical power to energise the LED, a source of gas (for example nitrogen or argon) having a low or effectively zero proportion of oxygen, means for discharging the gas such that the ink to be cured is blanketed such as to exclude atmospheric oxygen while it is exposed to the radiation emitted by the LED, and means for conveying the substrate being printed with ink under the blanket of gas.

BRIEF DESCRIPTION OF THE DRAWINGS

Preferred features of the present invention will now be described, purely by way of example, with reference to the accompanying drawings, in which.

DESCRIPTION OF THE PREFERRED EMBODIMENTS

The radiation sources described below comprise LEDs. However other sources could be used. In particular, a source of UV light which has a relatively narrow spectral output distribution could be used, for example a laser source. For example an OSRAM XERADEX® excimer discharge lamp could be used.

Figure 1:
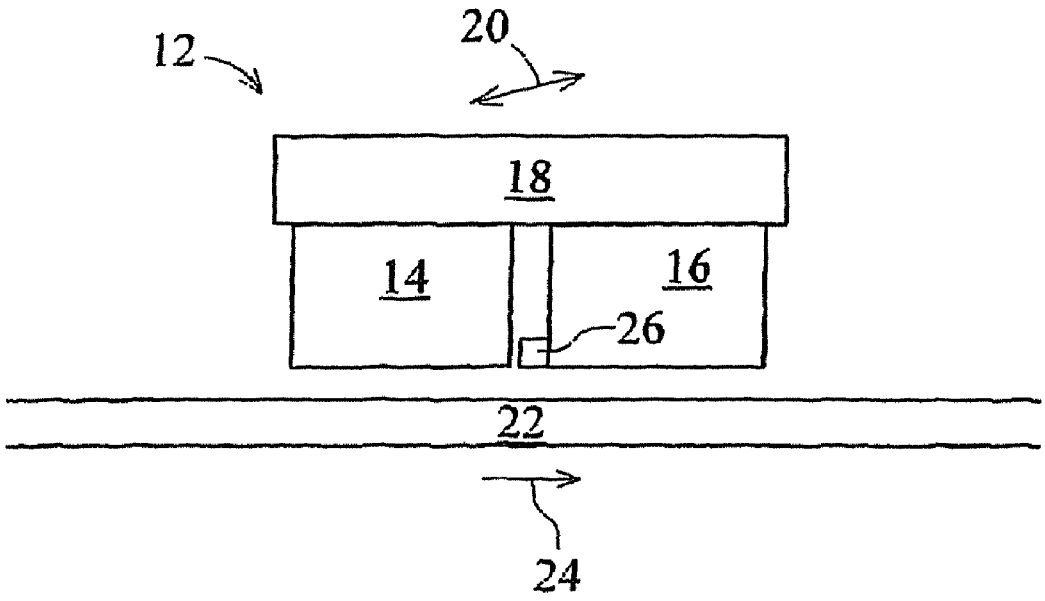
FIG. 1 shows schematically the printing and curing apparatus of an ink jet printer.

FIG. 1 shows schematically a part of an ink jet printer. The figure shows a part of a print carriage 12 which includes an array of printheads 14 and a curing assembly 16. The printheads 14 and curing assembly 16 are mounted on a common support 18 which is arranged for reciprocal movement 20.

In use, the print carriage 12 is arranged above a substrate 22 which is arranged for reciprocal movement 24 in a direction substantially perpendicular to the direction of reciprocal movement 20 of the printhead.

During printing, ink is ejected from the printheads of the array 14 towards the substrate 22 in a known manner. The substrate 22 is moved in direction 24 during printing (from left to right as shown in FIG. 1) so that the desired image is formed on the substrate 22 by the ejected ink. As printing proceeds, ink is printed onto the substrate and then the printed ink passes under the curing assembly 16. At the end of a print swathe, the substrate retracts to its start position; during this retraction motion, the printheads are inactive and the print carriage indexes across to a position for printing the next swathe.

For full colour printing, the array of printheads 14 comprises four sets of printheads for cyan, magenta, yellow and black ink, respectively. After the ink is ejected onto the substrate 22, it is cured using the curing assembly 16 to fix the ink in position.

Figure 2B:
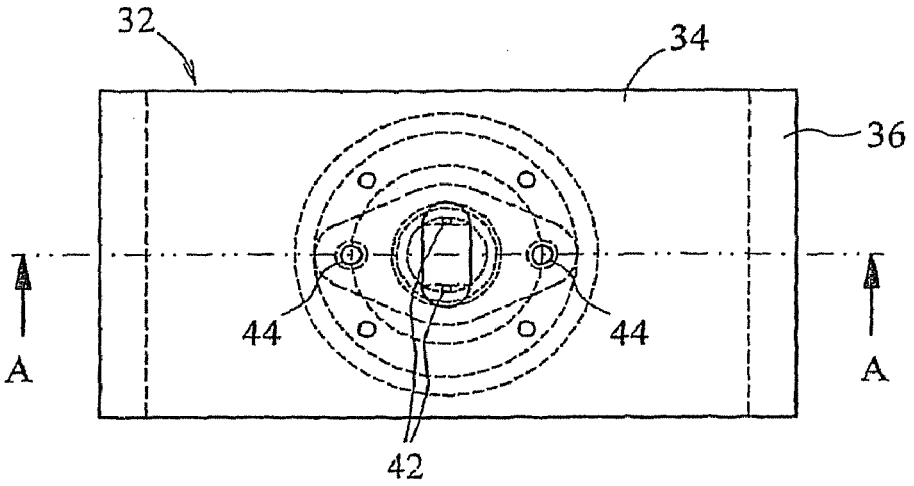
FIGS. 2*a* and 2*b* show the curing apparatus arrangement of FIG. 1 in more detail.
Figure 2A:
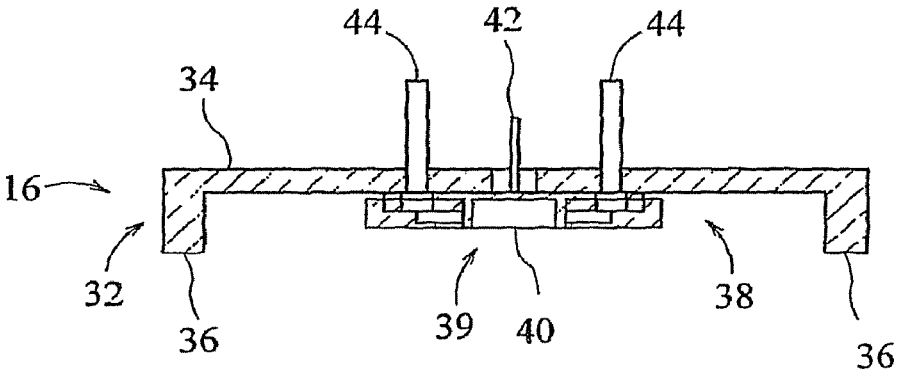

FIGS. 2*a* and 2*b* show in more detail the curing arrangement 16. The arrangement includes a housing 32 having a roof 34 and two downwardly depending side walls 36. The roof 34 and walls 36 form an enclosed area 38 which is enclosed on two sides by the side walls 36 and is open on the other two sides. The curing arrangement is mounted in the printer such that one of the open sides of the housing 32 is immediately downstream of the printhead arrangement 14. This arrangement shows the set-up used for experimentation. The roof and walls of the enclosure are arranged to enable the arrangement to be moved by hand while keeping a fixed distance between the LEDs and the substrate. For an arrangement to be used in practice for printing, preferably the walls 36 would extend around all four sides of the housing to try to minimise the ingress of oxygen.

A cure area 39 is defined within the enclosed area, beneath the LED source 40.

For the purpose of bench testing, the substrate 22 is traversed by the curing arrangement 16, the open sides of the housing 32 allowing the substrate to be traversed without smearing the uncured ink. The base of the side walls 36 and the underside of the substrate 22 rest on the bench top (in the same plane) such that the lower face of the LED source 40 is close to the upper surface of the substrate 22 onto which a sample of ink is placed. For dynamic testing, the housing 32 excludes the side walls 36 and the unit is mounted onto the print carriage 12. The lower face of the LED source 40 and the nozzle plates of the printheads 14 are at the same height above the substrate 22 being printed. The upper surface of the substrate 22 being printed is about 1.5 mm below the face of the LED source 40.

As printing proceeds, the curing arrangement 16 passes over the ink which has been ejected by the printheads 14. As the curing arrangement 16 moves relative to the substrate 22, the housing 32 becomes located directly over the area of the substrate to which ink has been applied.

The curing arrangement 16 further includes an LED source 40. As the newly ejected ink passes under the housing 32, it is cured by the radiation emitted from the LED source. Electricity to power the LED is supplied via two wires 42 (more clearly seen in FIG. 2*b*).

The curing arrangement 16 further includes two nitrogen feeds 44 which are connected to a nitrogen supply and which introduce nitrogen into the cure area 38 within the housing 32. This provides a nitrogen blanket over the ink to be cured. In this way, the amount of oxygen adjacent the ink to be cured is reduced compared with ambient conditions, and thus the rate of oxygen inhibition of UV curing of the ink is reduced.

FIG. 1 further shows schematically a purging arrangement 26 which may be arranged upstream of the curing arrangement 16. The purging arrangement 26 directs a jet of nitrogen towards the substrate 22 upstream of the LED arrangement 16. The jet of nitrogen reduces the amount of air which is entrained under the curing arrangement and therefore can reduce the amount of oxygen rich gas in the region of the ink being cured.

Figure 3:
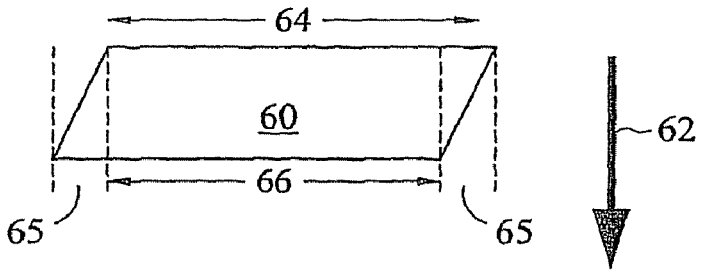
FIG. 3 shows schematically the shape of an array of light emitting diodes for use in a curing apparatus.

FIG. 3 shows schematically the shape of an array of LEDs for use in curing ink laid down by an ink jet printhead. The array 60 is generally in the shape of a parallelogram. The direction of relative movement of the substrate 22 and the curing arrangement 16 is shown (cure direction 62). The LEDs of the array are arranged in rows generally perpendicular to the cure direction 62; the rows have a width 64 and include 50 LEDs evenly spaced as shown in more detail in FIG. 4. Different arrangements are possible, for example, the array shown in FIGS. 6*a* and 6*b* includes 5 parallel rows of 20 LEDs. Each row is offset slightly from neighbouring rows to give a parallelogram shape.

It will be understood, therefore, that the arrangement of the LEDs in the array is such that there are no columns of LEDs which are substantially parallel to the cure direction 62. In this way, variations in the intensity of radiation received by the substrate across the width 64 of the array can be reduced compared with, for example, a regular rectangular array of LEDs. This gives a better cure performance.

Figure 4:
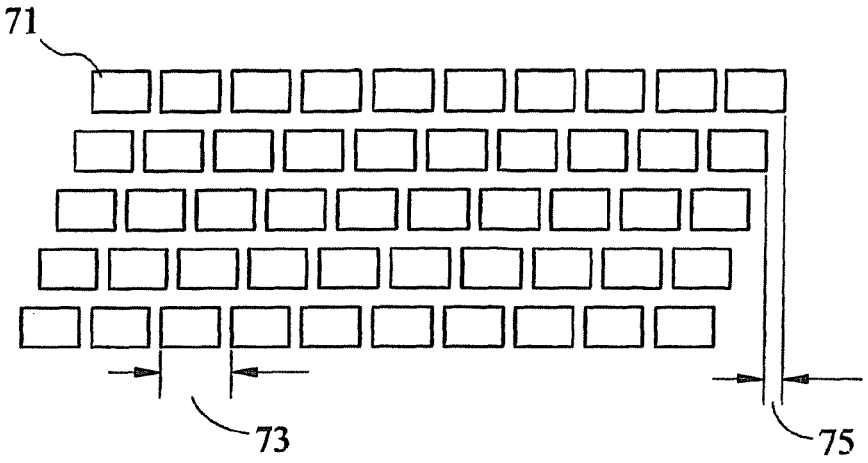
FIG. 4 shows schematically an array of light emitting diodes.

FIG. 4 shows in more detail an example of an array of LEDs 71. The LEDs 71 are arranged in five rows of ten LEDs giving, in this example, 50 LEDs.

The LEDs of a row are spaced having a pitch 73 (measured along the row from the edge of an LED to the corresponding edge of an adjacent LED in the row) of five units, the rows each being offset by an offset distance 75 equal to one unit. This gives a total offset from the LEDs of the first to last rows of 4 units, the width of one LED.

Thus the offset between each row is w/N where w is the pitch of the LEDs parallel to the cure direction, and N is the number of rows in the cure direction. Referring to FIG. 3, the central region 66 of the array having a full height of LEDs in the cure direction is preferably chosen to be equal to, or slightly greater than, the width of the nozzle array of the printheads.

Figure 5:
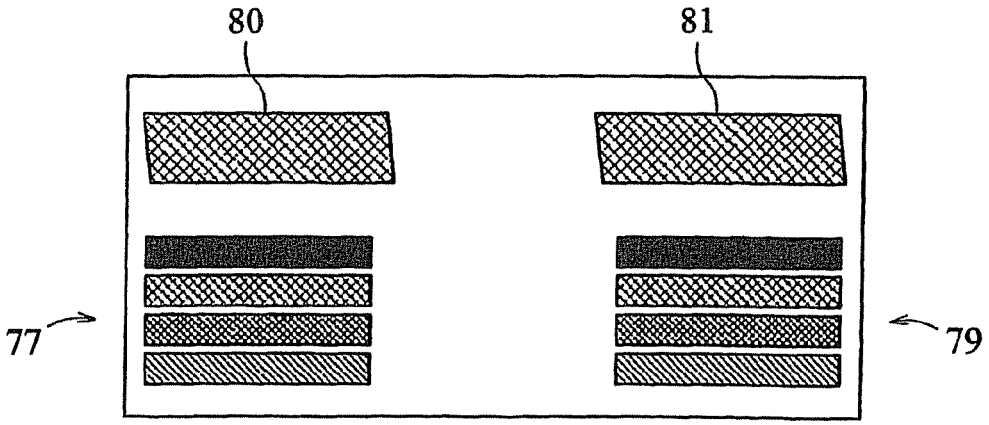
FIG. 5 shows schematically an example layout for a print cartridge.

Preferably the width of the LED array is substantially the same as the width of the 'swathe' of print laid down by the nozzle array. Where the array is not rectangular, preferably the width of the swathe of print is substantially the same as the width of the portion of the array having a "full" number of rows of LEDs (as shown in FIG. 5, for example). Different arrangements could be used. Where more than one swathe is laid down at a time, more than one LED array might be used. FIG. 5 shows schematically an example of the layout of a print carriage by which two swathes are laid down at a time by two sets of nozzle arrays 77,79. Each set of nozzle arrays includes four arrays of nozzles for colour printing using cyan, magenta, yellow and black ink.

Mounted downstream of each set of nozzle array 77,79 is an LED array 80, 81.

Figure 6A:
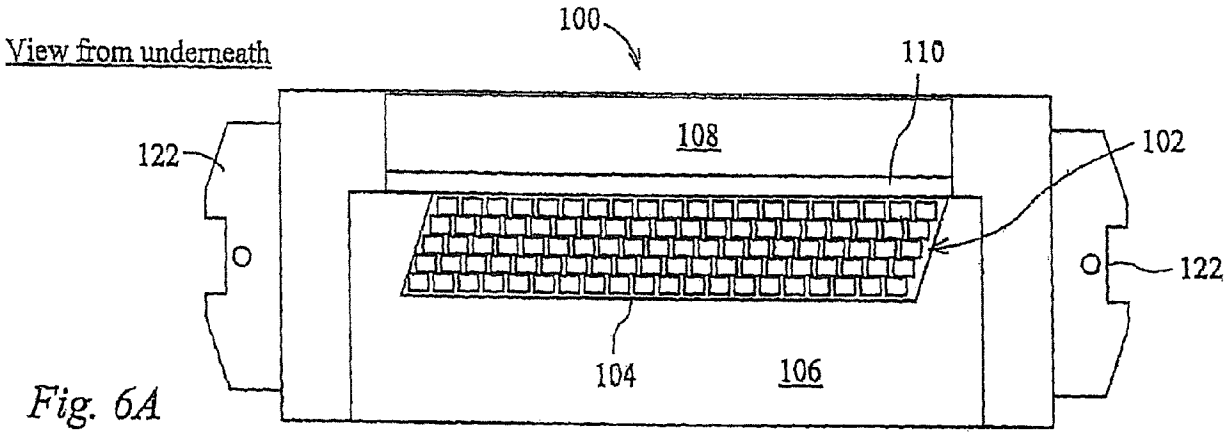
FIGS. 6*a* and 6*b* show, respectively, a view from underneath and side view of an LED array arrangement.

FIG. 6*a* shows a view of from underneath of an LED array arrangement for use in an inkjet printer.

The arrangement 100 includes an LED array 102 set into a cavity 104 in a surround 106. The arrangement 100 further includes a gas purge cavity 108 arranged adjacent the LED array 102 and extending the full width of the array, the gas purge cavity 108 and the LED surround 106 are at approximately the same height above the substrate in use. In use, nitrogen gas is supplied through a nitrogen outlet 110 to the gas purge cavity from nitrogen tubes 112 and supply ports 114 (see FIG. 6*b*).

In use, the LED arrangement 100 moves relative to the substrate such that the gas purge cavity 108 passes over the printed area of the substrate before the LED array 102 passes over that area and effects cure of the ink.

Figure 6B:
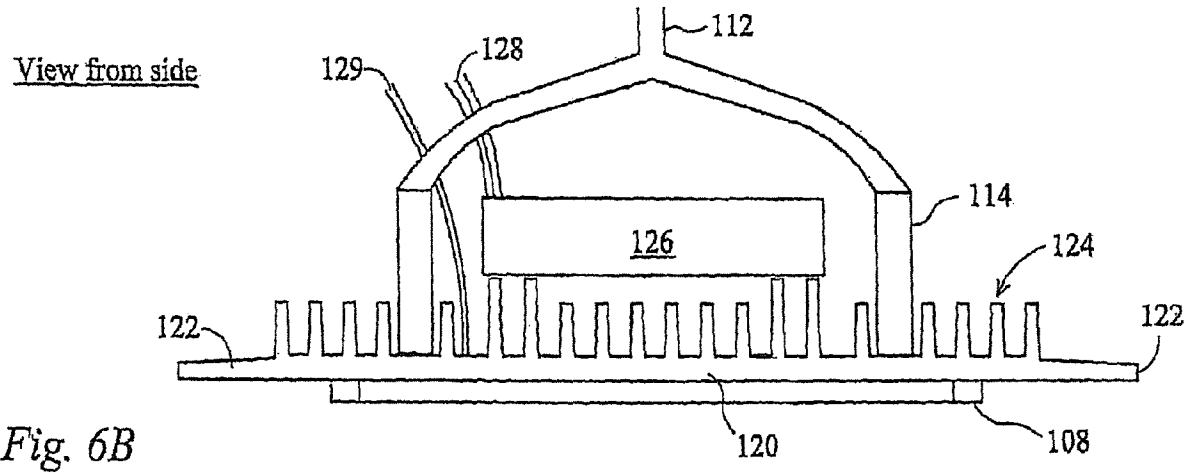

FIG. 6*b* shows the side view of the arrangement. In FIG. 6*b*, the gas purge cavity 108 is seen, and the LED array is set within the cavity 104 behind the LED surround 106. FIG. 6*b* shows that the arrangement includes a support 120 including a mounting bracket 122 at each end for mounting the arrangement in the printer. On the upper surface of the support 120 are cooling fins 124 which comprise a thermally conductive material and act to conduct heat from the LED array 102. A fan 126 is mounted on the cooling fins 124 to cool the fins.

FIG. 6*b* also shows the electrical wires 128,129 leading to the fan and the LED array, respectively.

The nitrogen gas is obtained from a device (not shown) which separates nitrogen and oxygen from the air using semi-permeable membranes, in a known way. By using such a device, the need for bottled gas is avoided, and there is no net release of nitrogen gas into the room. In an alternative arrangement, a source of carbon dioxide could used which may be safer than nitrogen because, unlike nitrogen, it causes a choking response in humans at elevated concentrations. Argon might be used as an alternative, but it is relatively expensive.

Figure 7A:
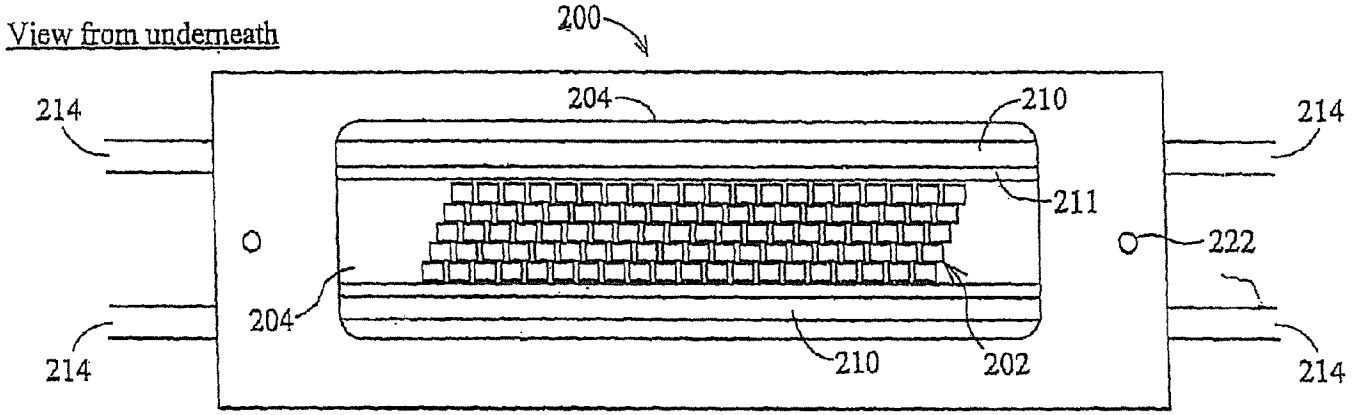
FIGS. 7*a* and 7*b* show, respectively, a view from underneath and side view of a further example of an LED array arrangement.
Figure 7B:
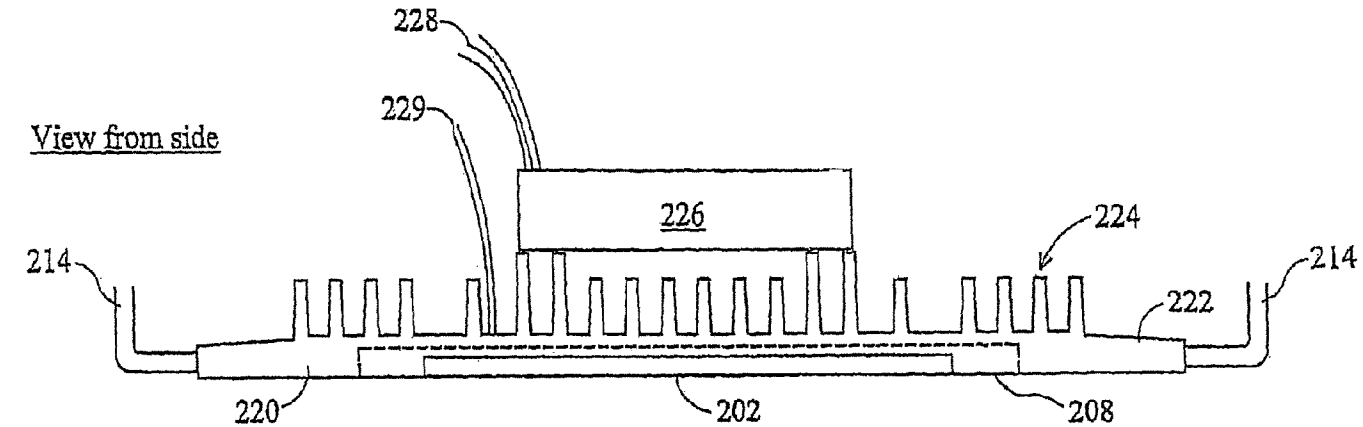

FIGS. 7*a* and 7*b* show an alternative example of an LED arrangement 200. The arrangement is similar to that shown in FIGS. 6*a* and 6*b* in that an array of LEDs 202 is set into a cavity 204. In this arrangement, however, the nitrogen is supplied directly into the LED cavity 204. A pair of metal pipes 210 are arranged on either side of the array; one upstream and one downstream. A nitrogen input 214 is provided at each end of each pipe 210. Each pipe 210 includes a slot 211 along its length within the cavity 204 so that nitrogen from the pipes 210 is emitted from the slots 211 into the cavity 204. The pipes 210 are rotatably mounted within the cavity so that the flow of nitrogen from the pipes can be directed as desired towards the ink to be cured.

As can be seen from FIG. 7*b*, the arrangement includes a support 220 having a mounting bracket 222 at each end and cooling fins 224 on its upper surface. A fan 226 is mounted on the cooling fins for cooling the support. Wires 228 and 229 connect with the fan 226 and LEDs 202, respectively.

In a further example, a number of holes are introduced in the cavity between the LEDs. The oxygen-reduced gas is introduced into the cavity through the holes, thus increasing the pressure and providing a positive pressure of gas at the region where radiation is emitted onto the ink, thus improving cure.

A large potential improvement in the system performance can be obtained by "tuning" the ink characteristics to the output of the chosen radiation source, for example an LED source. The curing reaction occurs when the ink is exposed to radiation, and it is therefore highly preferable that the absorption characteristics of the ink match the emission output of the radiation source.

Examples of LED curing devices and inks suitable for use in the method described above are described below.

Example 1

UV Curable Ink for Use with a 382 Nm LED

Ink Formula A:

Propoxylated neopentylglycol diacrylate 74.91 parts

Solsperse 32000 (dispersant from Avecia) 0.48 parts

Irgalite Blue GLVO (blue pigment from Ciba) 1.44 parts

Genorad 16 (stabiliser from Rahn AG) 0.12 parts

Rapi-cure DVE-3 (difunctional vinyl ether from ISP Europe) 15.0 parts

Lucerin TPO (photoinitiator from BASF) 8.0 parts

Byk 307 (defoamer from BYK Chemie) 0.05 parts

The composition was an ink having a viscosity of 16 mPas at 25 C. The ink was coated onto self-adhesive vinyl and was successfully cured under reduced oxygen environment when exposed to an LED source which emitted radiation having a peak wavelength of 382 nm. The LEDs used were EIS09-OPOA9-02 of Roithner Lasertechnik.

Example 2

UV Curable Ink for Use with a 405 Nm LED

Experiments were carried out in the lab using a LED B95-66-60 source available from Roithner Lasertechnik and mounted in a housing which allowed nitrogen to be pumped through as shown in FIGS. 2*a* and 2*b*. The nitrogen source used was a HNG3-4B available from Hankison International. The use of such a source has the advantage that there is no net nitrogen liberated in the area of the printer, and that there is no need for a supply of bottled gas.

Such an arrangement did leave some residual oxygen in the nitrogen output, but it was found that the level of residual oxygen was low enough (<1%) to allow full cure of the ink using the conditions below:

| | |
|---|---|
| Inks | Sericol UviJet ink (cyan, magenta, yellow and black)- a free radical curing ink |
| LED Input power | 18 V 300 mA |
| Peak emission | 405 nm |
| Nitrogen flow rate | 0.18 m3/hr |
| Speed of curing assembly | I. Om/s relative to the substrate |
| Ink laydown on substrate | 18 g/m2 |

The arrangement was found to give full cure of the ink laid down by the printheads 14.

Inks: Sericol UviJet ink (cyan, magenta, yellow and black). The formula for ink Formula B is shown below:

Ink Formula B:

| | |
|---|---|
| Propoxylated neopentylglycol diacrylate | 74.91 parts |
| Solsperse 32000 (dispersant from Avecia) | 0.48 parts |
| Irgalite Blue GLVO (blue pigment from Ciba) | 1.44 parts |
| Genorad 16 (stabiliser from Rahn AG) | 0.12 parts |
| Rapi-cure DVE-3 (difunctional vinyl ether fiom ISP Europe) | 15.0 parts |
| Irgacure 369 (photoinitiator from BASF) | 8.0 parts |
| Isopropyl Thioxanthone (photosensitiser from Lambson) | 2 parts |
| Byk 307 (defoamer from BYK Chemie) | 0.05 parts |

The absorption of the photoinitiators are generally low at 405 nm and it is preferable to use a sensitiser.

The composition was an ink having a viscosity of 16.8 mPas at 25 C. The ink was coated onto self-adhesive vinyl and was successfully cured under reduced oxygen environment when exposed to an LED source which emitted radiation having a peak wavelength of 405 nm.

Figure 8:
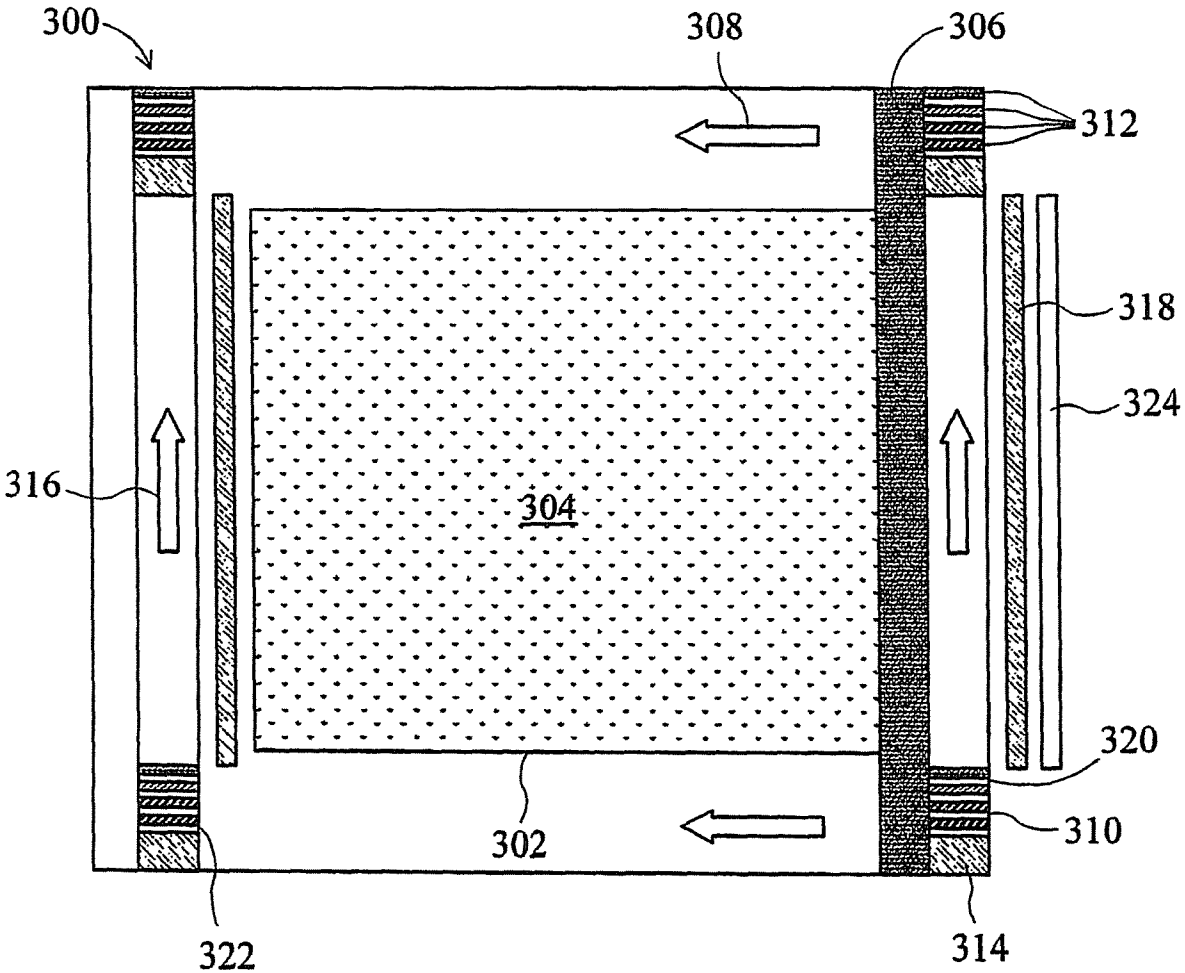
FIG. 8 illustrates a printer arrangement using LEDs to provide curing radiation.

FIG. 8 shows a printer arrangement in which a "partial cure" is first carried out by a radiation source mounted on the printheads to fix the ink printed on the substrate. A full cure is then completed by a separate radiation source. In this arrangement, both the partial cure source and the full cure source comprise LEDs, but other sources could be used for either or both of these.

FIG. 8 shows a top view of an inkjet printer 300. The components of the printer 300 shown include a substantially flat substrate table 302 for supporting the print substrate 304, above which X axis beam 306 is mounted for movement across the substrate in the Y-Axis direction 308. An inkjet printer carriage 310 comprising multiple printheads 312 and partial curing LED array 314 is mounted to the beam 306.

Carriage 310 is arranged to move up and down in the X-Axis direction 316 along the beam 306. In another example, the partial curing radiation source may comprise a UV lamp.

As shown in FIG. 8, the substrate 304 does not move and the movement of the beam 306 from right to left in the Y-Axis direction 308 is substantially perpendicular to the movement of the carriage 310 along the beam.

A full cure LED array 318 is provided mounted to the beam 306. The LED array 318 emits curing radiation with a wavelength in the region of 390 to 400 nm. In another example, the full cure radiation source may comprise a UV lamp. The full cure LED array 318 has a length substantially equal to the full width of the substrate table 302 in the X-direction 316 and is mounted on the beam 306 such that it is above the substrate table 302 such that its length is disposed in the X-direction 366 parallel to and at pre-determined lateral distance from the X-Axis Beam 306.

The full cure LED array 318 is provided with an inerting system 324 which provides a nitrogen inerting gas at the substrate 104 at surface of the ink which is to be fully cured. For example, the arrangement shown in FIGS. 6*a* and 6*b* could be used. In this example, the nitrogen gas is provided at the substrate only during the full cure step when the oxygen inhibition effect which inhibits curing of the ink is no longer required or desirable at the surface of the ink. No inerting is provided in relation to the partial cure source.

The full cure LED array 318 moves laterally in the Y-Axis direction 308 from right to left across the substrate with the movement of the X-Axis beam 306. Alternatively, the full cure LED array 318 is mounted such that the beam 306 is capable of movement relative to the full cure LED array 318; for instance, the array may pass over the substrate on a separate transport mechanism.

The carriage 310 contains inkjet printheads 312. The partial cure LED array 314 is mounted behind the printheads 312 so that during printing as the carriage 310 moves the partial cure LED array 314 trails the printheads 312 as the carriage 310 and LED array 314 move over the substrate 304.

Printing starts with the carriage 310 in the start position 320 at the bottom right corner of the substrate table 302. The carriage 310 moves along the stationary X-Axis beam 306 in the X-Axis direction 316 thereby moving the printheads 312 and partial cure LED array 314 across the substrate 304 during which time ink is jetted from the inkjet printheads 312 on to the substrate, thereby effecting a print stroke across a particular area of substrate, each printhead forming a rectangular "stripe" of printed area parallel to the X-Axis beam 306. The width of the rectangular stripe of printed area is about the width of a printhead.

When all the ink to be deposited on the substrate during a particular print stroke has been jetted from the inkjet printheads 312, the X-Axis beam 306 indexes in the Y-Axis direction 308 a pre-determined amount, normally smaller than the width of the printheads 312, depending on the print mode selected. The carriage 310 then performs a second print stroke as described above, thereby covering the area of the substrate by further print strokes each preceded by the indexing to the left of the X-Axis beam 306.

The printing continues until the arrangement of the X-Axis beam 306, carriage 310, partial cure LED array 314 and full cure LED array 318 are at the end position 322 at the bottom right corner of the substrate table 302.

As described above, in some cases, for example where the radiation source is mounted on the printheads and the speed of movement of the printheads varies, it is desirable to vary the radiation intensity from the source so that the desired level of gloss is maintained.

One method of varying the intensity of curing radiation received by the ink is by using a combination of one or more radiation sources, and using a simple switching circuit which is arranged to switch on the desired number of sources to achieve a desired surface finish.

An alternative method of varying the intensity of the curing radiation received by the ink is to vary the level of radiation emitted by a source, which can be achieved by varying the input power to the source as described below in relation to FIG. 9.

Figure 9:
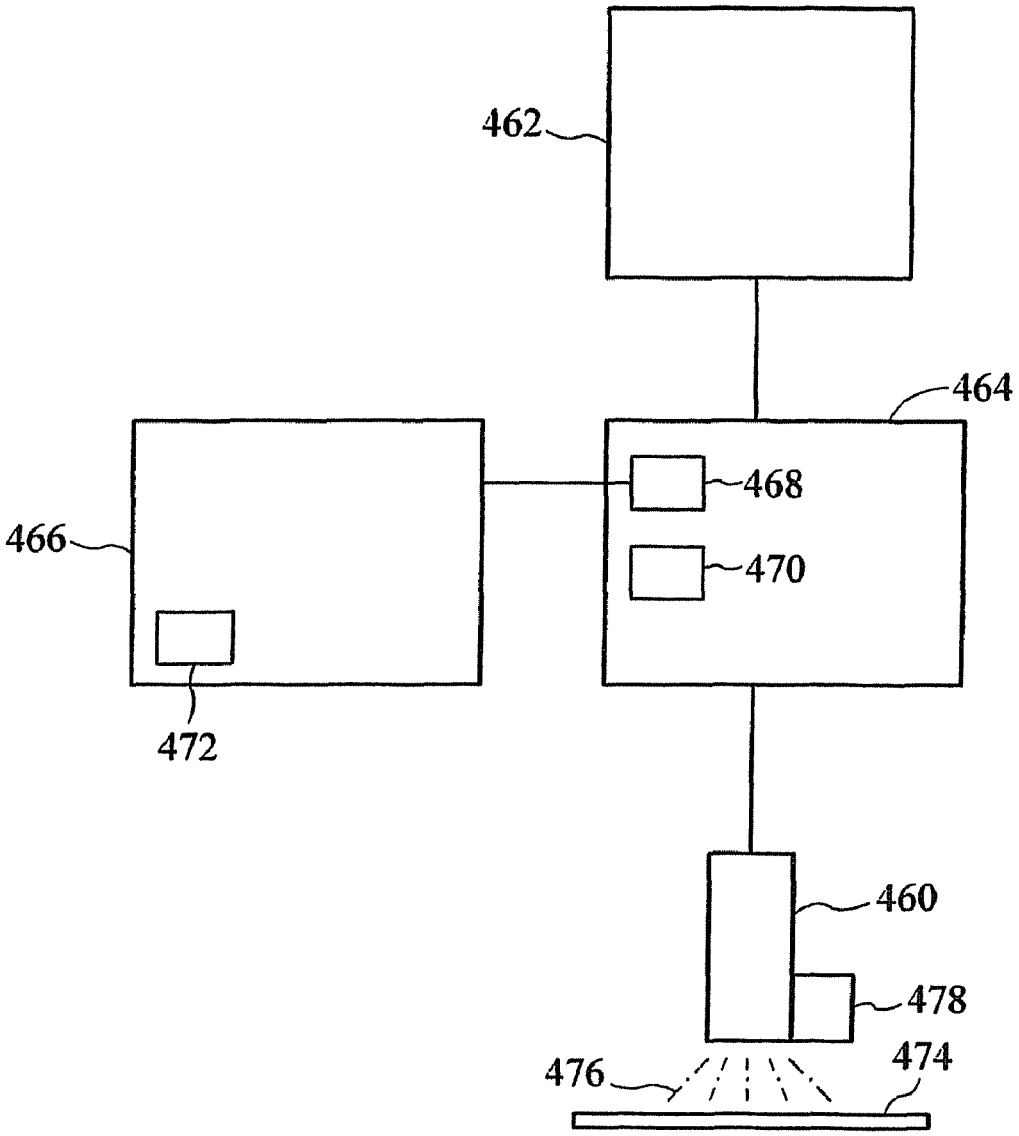
FIG. 9 illustrates a variable-power radiation source. Examples are described below where curable ink is printed onto a substrate. It will be appreciated that the use of radiation sources to effect cure as described is also applicable to the cure of other fluids

FIG. 9 shows a schematic of an example of a radiation source which is arranged to have its input power varied. A radiation source 460 is fixed to a printhead 478. The source 460 emits curing radiation 476 onto a substrate 474 and is supplied with electrical power by a power supply 462 via a power supply regulator 464. The power supply regulator 464 is controlled by a controller 466 via a signal interface 468 and/or a manual control 470. The controller 466 is provided with an interface 472 which permits signals from an external device, such as a printer control circuit (not shown) to cause the controller 466 to regulate via the regulator 464 the input power to the source 460.

A conventional inkjet printhead can move at varying velocities whilst printing, which can result in different regions of ink receiving different exposure times and levels of curing radiation. The relative speed of the motion of the printhead and source to the substrate, given a source power output, can determine the level of radiation received at the ink on the substrate. This variation in exposure at different regions of the substrate can lead to non-uniform surface finishes across the substrate.

It will be seen that a fixed level of gloss of the ink on an area of the substrate whilst printing at varying speeds can be achieved by varying the level of the curing by using a set up as described with reference to FIG. 9.

The level of cure can be regulated by the controller 466 which can be used to regulate the power being supplied from the power supply regulator 462 to the partial source 460. Alternatively, a printing circuit in a printing system (not shown) can be used to interface with interface 472 or interface 468 to control the input power to the source based on, for example, the speed of the printhead whilst printing, or the image to be printed.

In some situations it may be desired instead to vary the level of gloss of the printed ink, which can be achieved by varying the level of curing on a printed substrate independently of the rate of printing, for example by adjusting the power supply regulator by adjusting manual control 470 or by electronic signal received by signal interface 468.

It will be understood that the present invention has been described above purely by way of example, and modification of detail can be made within the scope of the invention.

Each feature disclosed in the description, and (where appropriate) the claims and drawings may be provided independently or in any appropriate combination.

What is claimed is:

1. A method of printing with a radiation-curable printing ink in an inkjet printer, the method including:

providing a print carriage comprising a printhead mounted on the print carriage immediately adjacent a curing arrangement, the curing arrangement including a radiation source;

a.) applying the ink to the substrate using the printhead;

b.) emitting radiation from the radiation source towards the ink to be cured on the substrate, wherein at least 90% of the radiation has a wavelength in a band having a width of less than 50 nm; and c.) providing an inerting environment in the region of the curing arrangement, the inerting environment being shrouded from the region of the printhead to contain the inerting environment adjacent the curing arrangement;

wherein the radiation source is moveably mounted in the printer and is arranged to index as the printhead indexes along the image.

2. A method according to claim 1, further including providing a shroud in the region of the radiation source.

3. A method according to claim 1, the method further including the step of providing a nitrogen inerting environment.

4. A method according to claim 1, including the step of feeding a low oxygen gas to a region adjacent the source.

5. A method according to claim 1, further including providing a gas curtain in front of the source.

6. A method according to claim 4, including providing a directable outlet for the low oxygen gas.

7. A method according to claim 1, including the step of supplying gas at a positive pressure in the region of the source.

8. A method according to claim 1, wherein the source is mounted in a cavity, the method including the step of positively pressurising the cavity.

9. A method according to claim 1, including cooling the source of radiation.

10. A method according to claim 1, wherein the radiation source includes an LED.

11. A method according to claim 10, wherein the LED emits UV radiation.

12. A method according to claim 11, the method including emitting radiation from an array of LEDs towards the ink.

13. A method according to claim 1, wherein the radiation is emitted from an elongated source.

14. A method according to claim 10, wherein the source comprises a plurality of rows of LEDs, wherein a row of LEDs is offset from an adjacent row of LEDs.

15. A method according to claim 1, wherein the fluid is reactive when exposed to radiation of a predetermined wavelength.

16. A method according to claim 1, further including the step of varying the power of the radiation source.

17. An inkjet printer for printing onto a substrate with radiation-curable ink and for curing the radiation-curable ink, the ink jet printer comprising:

a print carriage including an inkjet printhead for applying ink to the substrate, the inkjet printhead being mounted on the print carriage immediately adjacent a curing arrangement, the curing arrangement including:

a radiation source for emitting radiation towards the ink to be cured, wherein at least 90% of the radiation has a wavelength in a band having a width of less than 50 nm; and means for providing an inerting environment in the region of the curing arrangement, the inerting environment being shrouded from the printhead to contain the inerting environment adjacent the curing arrangement;

wherein the radiation source is moveably mounted in the printer and is arranged to index as the printhead indexes along the image.

* * * * *

UNITED STATES PATENT AND TRADEMARK OFFICE

CERTIFICATE OF CORRECTION

PATENT NO. : 8,398,229 B2
APPLICATION NO. : 12/843450
DATED : March 19, 2013
INVENTOR(S) : Jindrich Vosahlo et al.

It is certified that error appears in the above-identified patent and that said Letters Patent is hereby corrected as shown below:

Title page, item (73), should read:

--(73) Assignees: INCA Digital Printers Limited,
Cambridge (GB); Sericol Limited,
Kent (GB)--

Signed and Sealed this
Seventeenth Day of September, 2013

Teresa Stanek Rea
*Deputy Director of the UnitedStates Patent and Trademark Office*